United States Patent [19]

Gray

[11] 4,269,394

[45] May 26, 1981

[54] JACK ASSEMBLY FOR TRUCK TRANSMISSIONS, DIFFERENTIALS AND POWER DIVIDERS

[75] Inventor: Joseph L. Gray, St. Joseph, Mo.

[73] Assignee: Gray Manufacturing Company, Inc., St. Joseph, Mo.

[21] Appl. No.: 60,749

[22] Filed: Jul. 25, 1979

[51] Int. Cl.[3] ..... B66F 3/00

[52] U.S. Cl. ..... 254/134

[58] Field of Search ..... 254/133, 134, 8 B, 9 B; 269/17, 296

[56] References Cited

U.S. PATENT DOCUMENTS

| | | | |
|---|---|---|---|
| 2,748,459 | 6/1956 | Orr | 254/134 X |
| 3,958,793 | 5/1976 | Garate | 254/133 R X |
| 4,123,038 | 10/1978 | Meyers | 254/134 X |

*Primary Examiner*—Robert C. Watson

*Attorney, Agent, or Firm*—Schmidt, Johnson, Hovey & Williams

[57] ABSTRACT

The flat, load-carrying head of the jack may be adapted through a set of special adapter components for lifting, lowering and transporting irregularly-shaped objects such as heavy, unwieldy truck transmissions, differentials and power dividers notwithstanding their incompatibility with the flat surface of the platform. The components may be independently adjusted in a multiplicity of directions totally by hand and may be arranged in a variety of relationships such as to accommodate virtually any configuration presented by the particular object being handled and to do so relatively quickly without the use of special hand tools, certain of the components being especially suited for providing a low profile to the supporting head and the particular object being supported so as to facilitate manipulation of the jack in close quarters and under low overhead obstructions.

15 Claims, 19 Drawing Figures

FIG. 1
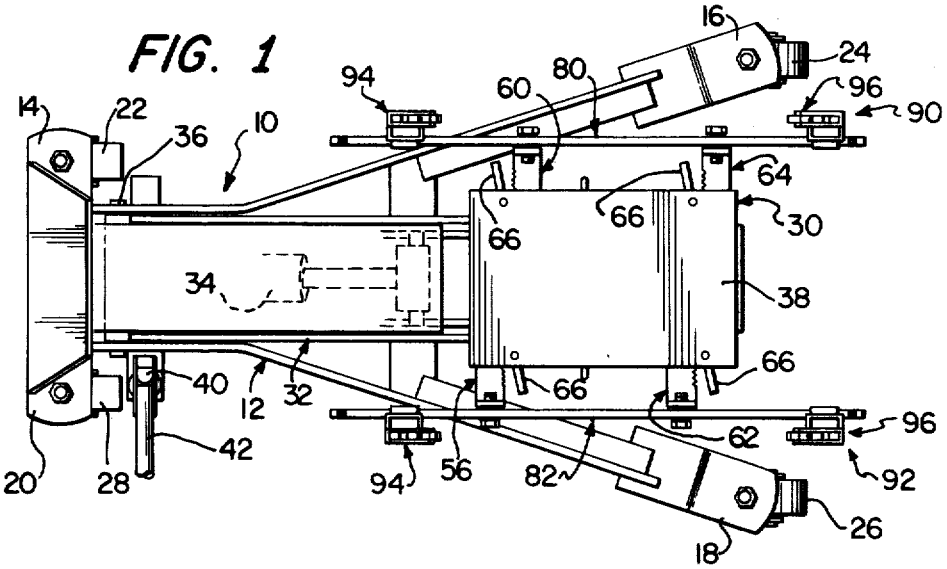
FIG. 2
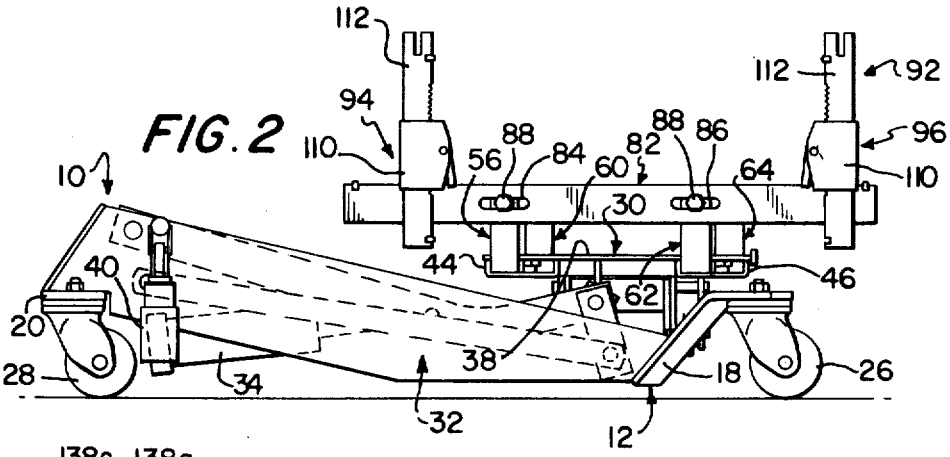
FIG. 3
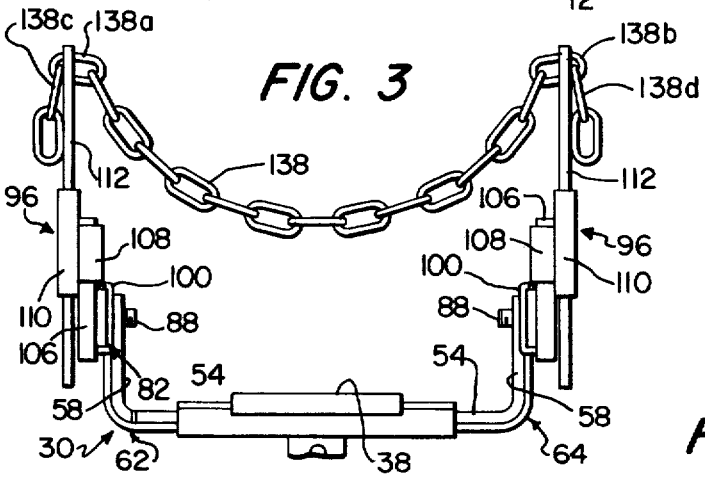
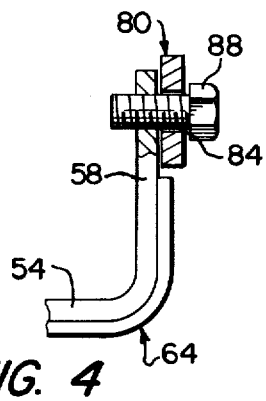
FIG. 4

FIG. 15
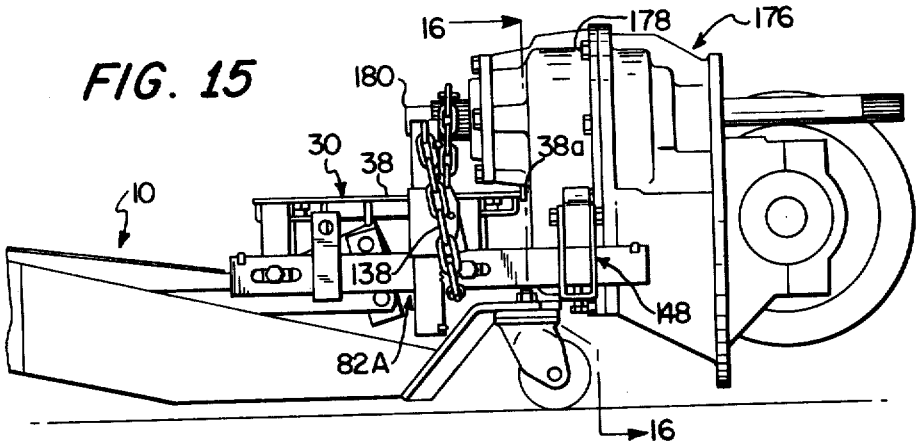
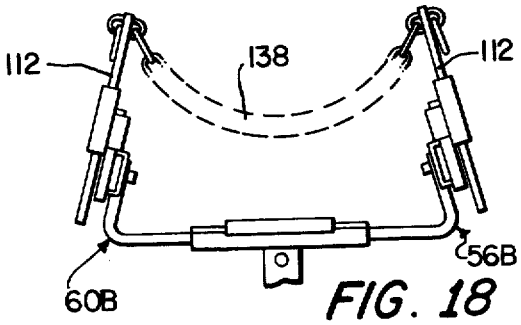
FIG. 18
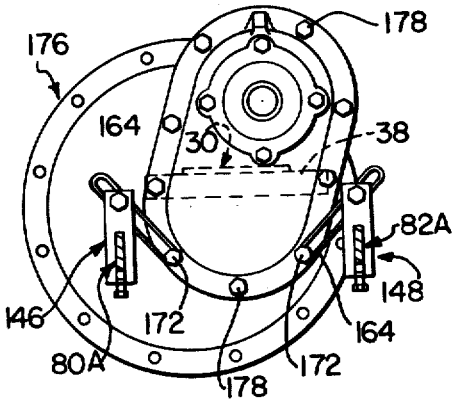
FIG. 16
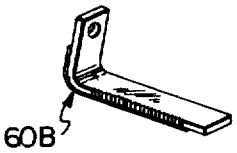
FIG. 19
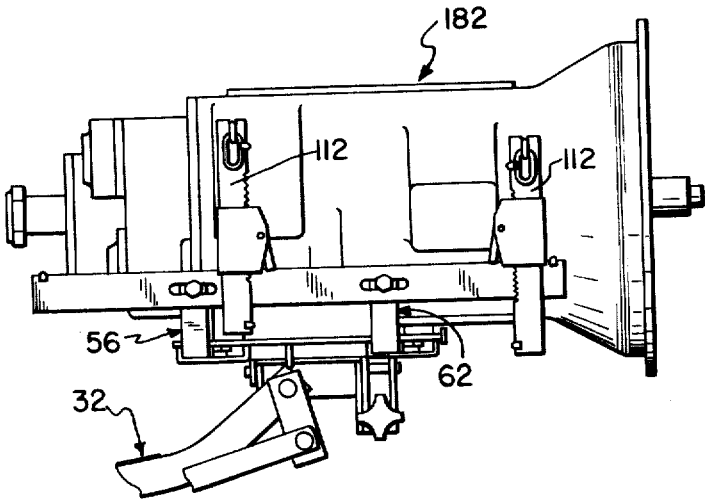
FIG. 17

JACK ASSEMBLY FOR TRUCK TRANSMISSIONS, DIFFERENTIALS AND POWER DIVIDERS

TECHNICAL FIELD

This invention relates generally to the field of industrial jacks used in connection with the servicing of heavy-duty truck gear train components in which the jacks are used to safely lower the components to the floor, support the components during service or repair, and raise the components back up into their properly registered position for replacement in the vehicle.

BACKGROUND ART

A wide variety of wheeled industrial jacks are presently available for use by mechanics during removal, service and reinstallation of truck gear train components and the like. Typically, such jacks are provided with a load-carrying head that receives the weight of the object being carried and which is raised up or down by lift mechanism of the jack so that the component can be correspondingly raised or lowered.

One increasingly serious problem with such jacks resides in the fact that their heads are frequently not compatible with the objects sought to be handled by the jack; that is, the head may have a flat, upwardly facing surface, for example, while the object has a rounded bottom or an otherwise irregularly-shaped protrusion that would be engaged by the head. In those instances, it becomes quite difficult to maintain the object securely situated on the head during the delicate removal of the component from the underside of the vehicle being serviced and the subsequent handling of such component during repair work. Furthermore, accessibility and cramped working quarters are always factors that influence and hamper service work of this type, and jacks heretofore available have not fully come to grips with making it possible for one man to have complete control over the unwieldy, heavy components under such cramped conditions.

Accordingly, there is a significant need in this art for a jack which will enable one man to safely yet quickly and without untoward effort handle a wide variety of heavy, unwieldy and irregularly-shaped objects such as truck gear train components and to do so within the cramped working quarters which usually confront the mechanic as he seeks to remove and reinstall the components on the underside of the vehicles.

SUMMARY OF THE PRESENT INVENTION

Pursuant to the foregoing, the present invention contemplates adapting the load-supporting head of a heavy-duty service jack through the use of multiple, interchangeable adapter components that can be selectively adjusted and arranged in a wide pattern of relationships such as to render the jack compatible with virtually any shape and size component with which the mechanic might be confronted. In lieu of using the head itself, the adapter components can be arranged so that the object is carried totally or at least primarily by engagement with the adapter components themselves which, by virtue of their inherent design, are uniquely compatible with the object.

Brackets projecting laterally outwardly from opposite sides of the head carry a pair of rails (support bars) situated in spaced apart locations along the opposite sides of the head and either above or below the latter depending upon which of the two invertible positions of the bars has been selected for the particular object at hand. Carriage assemblies on opposite ends of the rails can be shifted along the latter to any one of a number of possible positions totally independently of each other, such carriage assemblies in turn having means for attaching the same to the component being handled. In some circumstances, the carriage assemblies may include flexible chains supported at their opposite ends above the head and slung under the object being carried, while at other times special fastener devices employing bolts or the like may be threadably attached to the component either in conjunction with the underslung chains or totally independently thereof. The load-supporting carriages, in addition to being shiftable along the rails, may be adjusted vertically via hand-operated ratchet units, and they may likewise be adjusted inwardly and outwardly with respect to one another via hand-operated ratchet units associated with the laterally projecting bars from the heads.

One special arrangement of the adapter components allows the object being carried to be positioned substantially forwardly of the head and with a major portion thereof projecting downwardly below the surface of the head such as to render the overall combination significantly low in profile floor beyond that lower position which would otherwise be possible using the head in its normal way.

BRIEF DESCRIPTION OF THE DRAWINGS

FIG. 1 is a top plan view of a jack provided with one arrangement of adapter components according to the present invention;

FIG. 2 is a side elevational view thereof;

FIG. 3 is an enlarged, end elevational view of the adapter arrangement of FIGS. 1 and 2, FIG. 3 showing also the manner in which flexible chains may be utilized in an underslung, supporting manner for the object being handled by the jack;

FIG. 4 is an enlarged, fragmentary, detail view of the way in which the adapter rails are attached to their supporting adapter bars or brackets which are in turn attached to the platform of the load-carrying head of the jack;

FIG. 15 is a fragmentary, side elevational view of the jack with the adapter components arranged in such a manner that the head is adapted for supporting a power divider having a different configuration and center of gravity from that illustrated in FIG. 8, it being noted that a pair of adapter chains are utilized in connection with the power divider of FIG. 8 while one of the adapter chains and a pair of bolt-circle adapting fasteners are utilized in connection with the power divider of FIG. 15;

FIG. 16 is a fragmentary, vertical, cross-sectional view of the power divider and the bolt-circle adapter fasteners of FIG. 15 taken substantially along line 16—16 of FIG. 15;

FIG. 17 is a side elevational view of the head of the jack with the adapter components arranged in such a manner as to adapt the head for receiving and securely supporting a transmission assembly from a heavy-duty service vehicle such as a truck or the like, such an arrangement including the use of narrow angle adapter brackets in contradistinction to the wide angle adapter bars utilized in connection with the arrangement of FIG. 13, for example;

FIG. 18 is an end elevational view of the head adapted as in FIG. 17 and with the transmission assembly removed for clarity; and FIG. 19 is a perspective view of a narrow angle adapter bar used in connection with the configurations in FIGS. 17 and 18.

DETAILED DESCRIPTION

Figure 5:
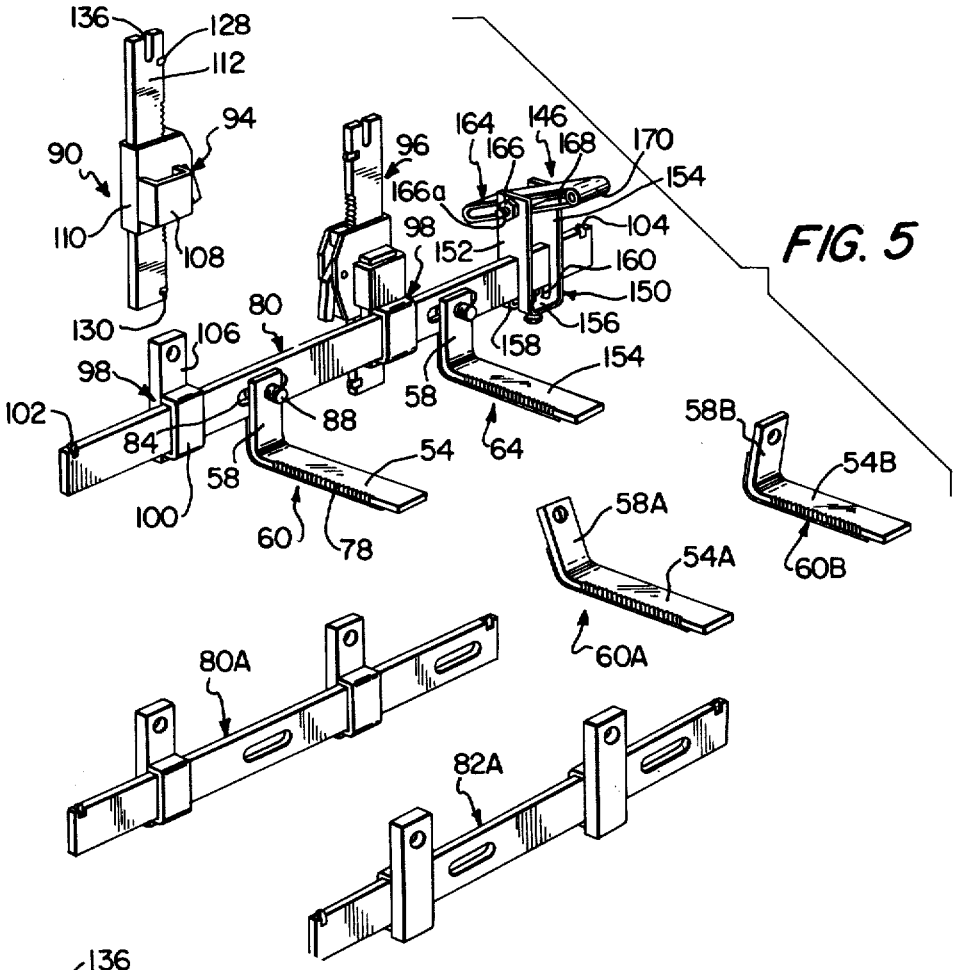
FIG. 5 is a perspective view of a variety of the adapter components which may be utilized in a number of different combinations in conjunction with adapting the head of the jack for handling objects.

The jack 10 has a frame broadly denoted by the numeral 12 which is provided with four legs 14, 16, 18 and 20, said legs 14–20 being respectively provided with ground-engaging caster wheels 22, 24, 26 and 28 rendering the jack 10 mobile. A load-supporting head 30 is located symmetrically between the diverging legs 16 and 18 generally above the latter and is carried by lift linkage denoted broadly by the numeral 32, said linkage 32 in turn being operably coupled with a lift cylinder 34 secured to the frame 12 such that, when the cylinder 34 swings the linkage about a transverse, horizontal pivot 36 between the latter and the frame 12, the head 30 is raised and lowered, such raising and lowering being effected with the top, upwardly facing platform surface 38 of head 30 remaining in a level condition due to the particular arrangement of the linkage 32. Although not shown in detail, it will be understood by those skilled in the art that the jack 10 may also be provided with control mechanism for tilting the head 30 into any one of a number of selectable positions relative to the linkage 32, and it should further be pointed out that the cylinder 34 is operated via a pump 40 which in turn is provided with a pump handle 42 grasped by the user and reciprocated vertically to inject fluid under pressure into the cylinder 34.

Figure 7:
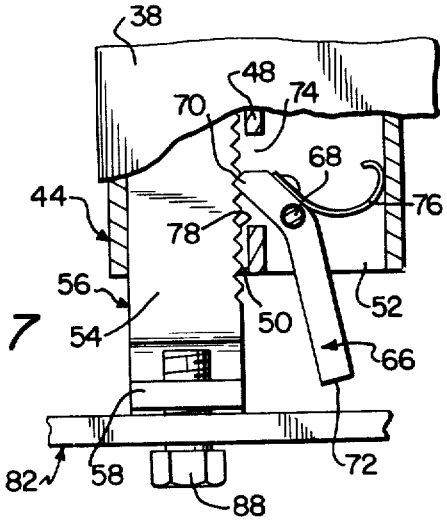
FIG. 7 is an enlarged, fragmentary, detail view of the adjustment mechanism associated with the head of the jack and the laterally projecting adapter bars which facilitate inward and outward adjustment of the latter.

Pursuant to the principles of the present invention, the head 30 may be adapted to receive and support unwieldy, irregularly-shaped, relatively heavy objects. In this regard, the head 30 is provided with a pair of transversely extending, generally U-shaped channels 44 and 46 at its opposite, normally front and rear ends, said channels 44,46 being attached to the underside of the platform surface 38 as illustrated best in FIGS. 2 and 7. As illustrated with respect to the channel 44 in FIG. 7, the latter has a partition 48 extending the length thereof and subdividing the channel 44 into a pair of subchannels 50 and 52 running along opposite sides of the partition 48. The subchannel 50 slidably receives the long leg 54 of a generally L-shaped adapter bar 56, said bar 56 also having a short leg 58 projecting upwardly or downwardly from the long leg 54 in perpendicular relationship therewith. In like manner, although from the opposite side of the head 30, the subchannel 52 slidably receives an L-shaped adapter bar 60 as illustrated in FIG. 2. The channel 46 functions in the same manner as the channel 44 and likewise receives an L-shaped adapter bar 62 on one side of the head 30 and a second L-shaped adapter bar 64 on the opposite side of the head 30. Thus, the head 30 is provided with four adapter brackets or bars 56, 60, 62 and 64 projecting outwardly from opposite sides thereof and each having their long leg 54 slidably received within the corresponding subchannel 50 or 52 of the corresponding channel 44 or 46.

Each of the adapter bars 56, 60, 62 and 64 is provided with mechanism permitting substantially infinite adjustments thereof in a lateral sense within certain limits. The particular mechanism utilized is the same in each case and thus will be described in detail only with respect to the adapter bar 56 detailed in FIG. 7. Note in that figure that a pawl 66 has a vertical pivot 68 that secures the same to the floor of the subchannel 52 for swinging movement in a normally generally horizontal plane, the pivot 68 being located between the latching end 70 and the opposite handle end 72 of the pawl 66. An opening 74 in the partition 48 permits the latch end 70 to project through partition 48 into the subchannel 50 under the influence of a leaf spring 76, at which location the latch end 70 makes engagement with any one of a series of teeth 78 along a proximal stretch of the long leg 54 of bar 56. The handle end 72 of pawl 66 projects outwardly through the open end of the subchannel 52 such as to be readily accessible to the user, the geometrical relationship of the pawl 66 to the bar 56 being such that the bar 56 can be pushed closer inwardly to the head 30 without manually disengaging the pawl 66 from the teeth 78 because the spring 76 will yield under such force, but the bar 56 cannot be withdrawn from the channel 44 without first releasing the pawl 66 by swinging the latter in a clockwise direction viewing FIG. 7 so as to bring the latch end 70 out of engagement with the teeth 78.

As a result of this arrangement, the upright, short legs 58 of the bars 56 and 62 on one side of the head 30 may be shifted toward and away from the corresponding upright legs 58 of the bars 60,64 on the opposite side of the head 30. Moreover, it is important to note that since each of the bars 56, 60, 62 and 64 is provided with its own pawl 66 and teeth 78, each is independently adjustable relative to the other.

It is important to note that the adapter bars 56, 60, 62 and 64 have three alternate configurations in accordance with the principles of the present invention. All three are illustrated in FIG. 5 and elsewhere, FIG. 5 showing the just-described bars 60 and 64 in which the short legs 58 are in perpendicular relationship to the long legs 54. Said figure also shows a modified adapter bar 60A in which the short leg 58A is disposed at an angle of approximately 120° to the long leg 54A thereof. Additionally, FIG. 5 shows a third form denoted by the numeral 60B in which the short leg 58B is disposed at an angle less than 90° (approximately 75° ) with the long leg 54B. In all other respects the bars 60A and 60B are identical to the bars 56, 60, 62 and 64 and may be substituted therefor on a virtually instantaneous basis upon release of the pawls 66. One important feature of the invention is the fact that any combination of bars 56, 60, 62 and 64 may be used with all being the same or different as may be required to most effectively support a particular mechanism.

Each pair of the bars 56, 60, 62 and 64 on opposite sides of the head 30 serve as structure for attaching an adapter rail 80 or 82 to the head 30 in a normally outboard and upwardly spaced location with respect to the latter. The rails 80,82 extend generally along opposite sides of the head 30 but may be maintained either in or out of a parallel relationship to one another depending upon the adjusted positions of the bars 56, 60, 62 and 64. As illustrated in detail in FIG. 4, and also in FIGS. 2 and 5, each rail 80,82 is provided with a pair of elongated, longitudinally spaced apart slots 84 and 86 located to be in general registration with the spacing between the corresponding bars 56,62 or 60,64. A bolt 88 received within each of the slots 84,86 respectively is threadably received by the leg 58 of the corresponding bar 56, 60, 62 or 64 so as to releasably clamp the corresponding rail 80 or 82 against corresponding pair of legs 58. The elongated nature of the slots 84,86 provides a limited degree of longitudinal shifting of the rails 80,82 relative to the bars 56, 60, 62 and 64.

As illustrated in FIG. 5, an alternative embodiment of the rails 80,82 may be utilized. Such embodiment includes the rails 80A and 82A, the rails 80A and 82A being shorter than their counterparts 80 and 82 and offset in a forward direction for reasons which will hereinafter appear. Substitution of the rails 80A and 82A for the rails 80 and 82 is a simple process carried out by removal and reinsertion of the bolts 88.

In order to adapt the rails 80,82 for supporting objects, a pair of carriage assemblies, broadly denoted by the numerals 90 and 92, are provided on opposite ones of the rails 80,82 for attachment to or coupling with the load to be supported. Such carriage assemblies 90,92 may take several different forms, and in the embodiment illustrated in FIGS. 1-3, they take the form of a pair of individual units 94 and 96 on each rail 80,82. All of the units 94,96 are left and right (FIG. 2) and are individually adapted for movement along their corresponding rail 80,82 and for vertical adjustment as well.

To this end, and perhaps as shown most clearly in FIG. 5 with respect to the rail 80, each of the units 94,96 includes a bracket 98 having a collar 100 slidably receiving the rail 80 such that the bracket 98 can be positioned at any desired location along the rail 80 subject only to the limits defined by stops 102 and 104 at opposite ends of the rail 80 and further subject to the legs 58 of bars 60,64. It should be noted at this juncture that, by way of example, one of the brackets 98 has been illustrated as being on the outboard side of the bar 60 while the other bracket 98 is shown between the bars 60 and 64. If desired, both of the brackets 98 could be located on the outboard or inboard sides of the bars 60,64, and such could be accomplished simply by releasing the bolts 88, repositioning the necessary bracket 98 to the outboard side of the bar 64, and then reinstalling the necessary bolts 88.

In like manner, units 94 and 96 may be mounted directly only upstanding segments of brackets 56, 60, 62 or 64 in which event the rails 80 are not employed.

Each bracket 98 also includes an upstanding stud 106 which is adapted to be slipped into and removably received by a socket 108 integral with a tubular casing 110 that in turn slidably receives an elongated post component 112. The socket 108 is adapted to be retained upon the stud 106 by gravity, and this facilitates rearrangement and reorientation of the various adapter components of the present invention as will subsequently be seen.

Figure 6:
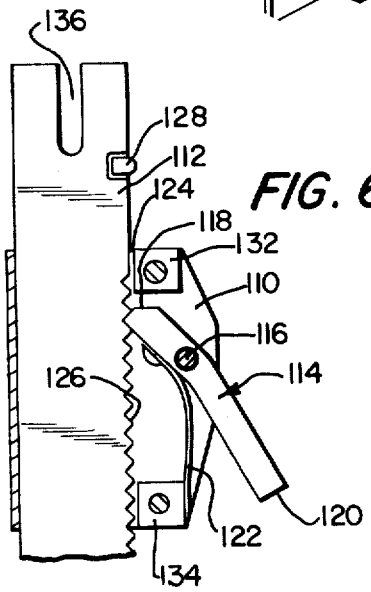
FIG. 6 is an enlarged, fragmentary, detail view of the vertical adjustment mechanism associated with one form of the carriage units slidable along the rail adapters.

FIG. 6 illustrates the manner in which each post 112 is adjustably held in a selected vertical position by means within the casing 110. In this regard, such means includes a pawl 114 attached to the wall of the casing 110 via a horizontal pivot 116, said pawl 114 having a latch end 118 and a handle end 120. Viewing FIG. 6, the pawl 114 is normally biased in a counterclockwise direction by a leaf spring 122 such that the latch end 118 projects into a vertical guideway 124 while the handle end 120 is swung out to an accessible position beyond the confines of the casing 110. A stretch of teeth 126 along the proximal side of the post 112 is disposed for ratcheting engagement with the latch end 118 of the pawl 114, and the geometrical relationship between the latter and the post 112 is such that post 112 can be raised to the extent desired without releasing the pawl 114 while lowering is precluded unless pawl 114 is swung against the bias of the spring 122 to disengage latch end 118 from teeth 126. Upper and lower limit stops 128 and 130 respectively on the post 112 at its opposite upper and lower ends are disposed for abutting engagement with corresponding upper and lower shoulders 132 and 134 on the casing 110 such as to define lower and upper limits respectively of vertical shifting movement of the post 112 relative to the casing 110. The upper end of the post 112 is provided with a deep notch 136.

As illustrated in FIG. 3, it is contemplated that when the units 94 and 96 are utilized, they will be accompanied by a flexible length of chain 138 that may be slung between the opposing posts 112 on opposite sides of the head 30 so as to sag down into the area defined above the head 30 and between the posts 112. Links **138*a* and 138*b* adjacent the opposite ends of the chain 138 may be inserted edgewise into the notches 136 of opposed posts 112 such that the next adjacent outer links 138*c* and 138*d* respectively, which are disposed transversely of the links 138*a* and 138*b*, will be in position to bear against the posts 112 upon the application of a loading force to the center of the chain 138 so as to prevent the latter from slipping through the notches 136. As is apparent, this arrangement promotes rapid adjustment of the slack, suspended length of the chain 138 slung between the posts 112**.

At this juncture it would appear instructive to discuss the manner of use of the structure thusfar described. The arrangement as generally shown in FIGS. 1-3 may be suitable for a large number of truck gear train components, particularly if a low silhouette or profile of the combination supporting head 30 and object to be carried is not of special concern in view of the absence of close, overhead obstructions. By adjusting the bars 56, 60, 62 and 64 inwardly or outwardly relative to one another upon release of the pawls 66 to the extent desired, the positions of the rails 80,82 will be correspondingly adjusted. Thus, adjustments may be made for the width of the gear train component to be handled by the jack 10.

Similarly, adjustments may be made in a fore-and-aft sense to the carriage assemblies 90,92 by simply sliding the brackets 98 to the desired positions along the rails 80,82.

Additionally, the posts 112 may be raised or lowered, releasing their respective pawls 114 when necessary, so as to locate their upper ends at the desired height, such locations being coordinated with the degree of underslung loop that is necessary in the chains 138 to properly receive and support the object to be handled. In this regard, it is most desirable to maintain the platform surface 38 of the head 30 spaced below the supported object such that contours and irregular surfaces on the supported object do not engage the flat surface 38 and serve as points of support. By using the chains 138 for this function, the configuration of the object being supported is of no concern since the chains will readily adapt to such contours as may be necessary. The slotted ends of parts 112 are moved toward each other by ratcheting appropriate bars 56, 60, 62 or 64 inwardly until chain 138 underlies and cradles the mechanism to be supported. Bolt 88 is allowed to remain loose permitting bar 82 to pivot so that the load on chain 138 tightens the grasping effect on the mechanism being held. As a result, the object is safely cradled between the posts 112 and is maintained securely under control at all times during support by the chains 138.

Since the bolts 88 can be left loose as shown in FIG. 4, all of the adjustments to the bars 56, 60, 62 and 64; the rails 80,82; and the posts 112 can be made independently of one another such as to yield an extremely high degree of flexibility insofar as adapting the head 30 for reception and support of the particular object is concerned. Thus, instead of being in parallel relationship to one another, the rails 80, 82 could be so maintained by their bars 56, 60, 62 and 64 that the rails 80,82 are converging with respect to each other, for example. Similarly, some of the posts 112 could be extended vertically more than others and could also be positioned at different locations along the lengths of the rails 80,82 as may be necessary or desirable. Still further, the adjustments are quite quickly and easily carried out by hand such as to provide virtually instantaneous adjustment by one man at the instant it is required. Also of importance is the fact that such adjustments are virtually infinite between relatively largely spaced limits.

Figure 8:
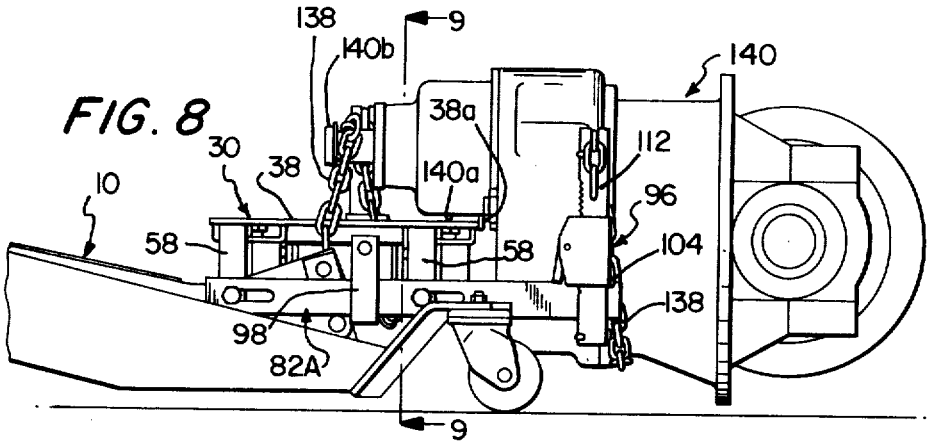
FIG. 8 is a fragmentary, side elevational view of the jack having the adapter components arranged in such a way that the head is adapted to receive and securely support an unwieldy object such as a power divider taken from a heavy-duty service truck.
Figure 9:
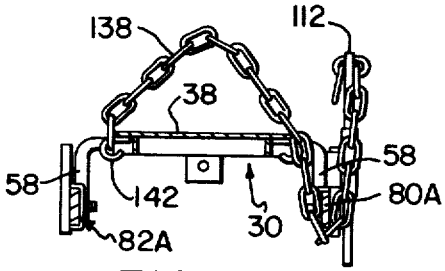
FIG. 9 is a vertical, cross-sectional view through the head and adapter components of FIG. 8 taken substantially along line 9—9 of FIG. 8.
Figure 10:
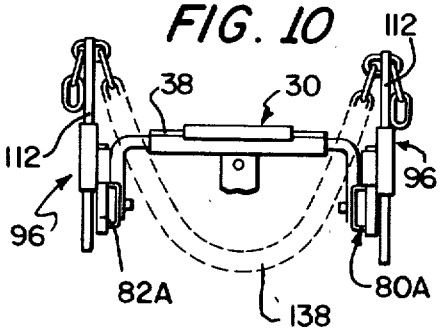
FIG. 10 is an end elevational view of the head and adapter components adjacent the end of the head opposite of that from FIG. 9 and showing a way in which the supporting chain at that location may be slung underneath the power divider, the latter object not being shown.

FIGS. 8–10 show the jack 10 adapted in a modified manner from that of FIGS. 1–3. In particular, the arrangement of the adapter components in FIG. 8 is especially well suited for situations in which power dividers such as the power divider 140 are to be handled, and it is of importance to provide a low overall profile to the combination of head 30 plus power divider 140. In this arrangement, the bars 56, 60, 62 and 64 have been removed and inverted from their "upright" orientation of FIGS. 1–3 such that the short legs 58 thereof project downwardly instead of upwardly from the platform surface 38 of head 30. Consequently, this disposes the rails 80 and 82 (or preferably the shorter rails 80A and 82A) down below the platform surface 38 instead of above the same as in the arrangement of FIGS. 1–3. The ratcheting pawls 66 are not used when the bars 56, 60, 62 and 64 are inverted inasmuch as the teeth 78 thereof are situated on the opposite side of the channels 50,52. However, this does not adversely affect the functionality of the bars 56, 60, 62 and 64 as will be seen.

It is necessary when the bars 56, 60, 62 and 64 are to be inverted to detach the same from the rails 80,82 or 80A and 82A such that the bars 56, 60, 62 and 64 may thereupon also be inverted relative to the rails 80,82 or 80A and 82A. This will maintain the units 94 and 96 in proper, upstanding attitudes such that the casings 110 and their posts 112 do not slip off the studs 106. Preferably, however, one of the casings 110 is removed from its stud 106 such as illustrated in FIG. 8 and is set aside at this time.

When the power divider 140 is to be handled by the jack 10, the two "forward" units 96 on opposite sides of the head 30 are positioned at their forwardmost locations against the stops 104. The front chain 138 is slung in the usual manner between the posts 112 such as to receive the belly of the divider 140 at a location substantially forwardly of and substantially below the front edge **38*a* of the platform surface 38. Edge 38*a* underlies and engages a proximal rearward portion 140*a* of the divider 140, and the rear chain 138 is looped over and across a rearwardly projecting shaft 140*b* of the divider 140 such as to hold down the rear end of the latter. As illustrated in FIG. 9, one end of the rear chain 138 may be looped over a safety hook or the like 142 on the underside of the platform surface 38, while the opposite end of the chain 138 is looped beneath the rail 80*a* and is thence extended upwardly to the upper end of the post 112 where it is slipped within the notch 136** thereof in the usual manner.

As illustrated clearly in FIG. 8, this arrangement permits the power divider 140 to be brought down very close to or even engaging the floor surface in spite of the fact that the head 30 can be lowered only to the lowermost position as illustrated wherein it is spaced substantially above the floor surface. Consequently, a relatively low overall profile is afforded to avoid low overhead obstructions, yet the use of the jack 10 as a supporting, elevating and transporting device is not sacrificed.

Figure 12:
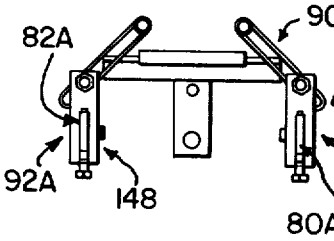
FIG. 12 is an end elevational view of the head arranged as in FIG. 11.
Figure 11:
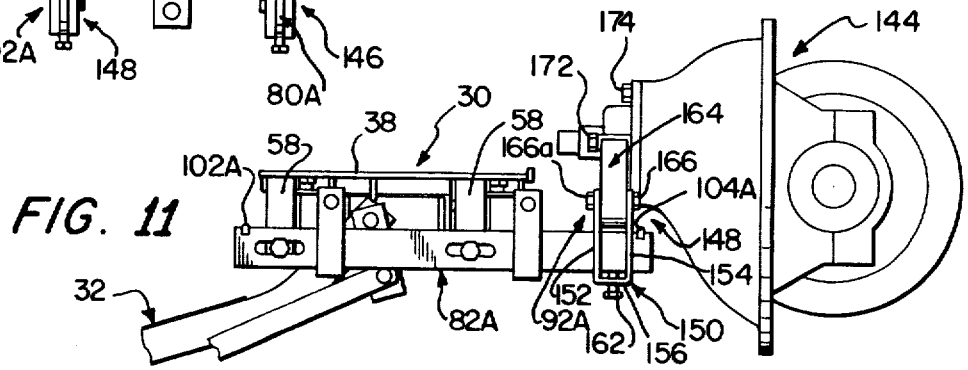
FIG. 11 is a fragmentary, side elevational view of the jack having the adapter components arranged in such a way as to adapt the head for receiving and securely supporting a differential from a heavy-duty service truck.

FIGS. 11 and 12 illustrate a way in which the head 30 may be especially adapted for handling a differential denoted by the numeral 144. In this arrangement the bars 56, 60, 62 and 64 are utilized as in FIGS. 1–3, but they are inverted as in the arrangement of FIGS. 8–10 and are preferably used in connection with the shorter rails 80A and 82A. In lieu of the previously utilized units 94 and 96, the carriage assemblies 90A and 92A on opposite rails 80A and 82A comprise special individual fastener units 146 and 148 which become threadably fastened to the differential 144. In this regard, and as also shown in FIG. 5 on the long rail 80, each of the fastener units 146,148 includes a generally U-shaped mount 150 having a pair of upstanding legs 152 and 154 interconnected by a lower, transverse bight 156. The legs 152 and 154 are provided with aligned, transverse slots 158 and 160 respectively so as to adapt the mount 150 for sliding reception of the corresponding rail 80A or 82A. The slots 158 and 160 are deep enough to permit the mount 150 to be slid completely off the end of the rail 80A or 82A notwithstanding the presence of the limit stop 102A or 104A, yet the mount 150 may be held in any one of a number of selected positions along the rail 80A or 82A by virtue of a set screw 162 threadably received by the bight 156 and disposable in locking engagement with the underside of the corresponding rail 80A or 82A.

Each of the fastener units 146 further includes an open-loop-shaped arm 164 having a transverse pivot bolt 166 passing through an interior, formed slot 168 thereof, the slot 168 extending substantially from one end of the arm 164 to the opposite end thereof such that the pivot bolt 166 may be positioned in a substantially infinite number of positions between such opposite ends of the arm 164, the latter being pivotable to any one of a number of angularly disposed positions about the bolt 166 when the nut **166*a* thereof is loosened. Arm 164 is then clamped in a selected such position when the nut 166*a* is retightened. A sleeve 170 at the normally inboard end of the arm 164 extends substantially parallel to the bolt 166 and is adapted to receive a bolt 172 (FIG. 11) which in turn may be threaded into a threaded hole (not shown) left vacant by a removed one of the circle of bolts 174 around the rear portion of the differential 144**.

With this arrangement, the differential 144 is supported substantially forwardly of the head 30 and with a large portion thereof substantially below the same such as to permit it to be lowered down near to or in engagement with the floor surface in the same manner as the power divider 140 illustrated in FIG. 8. And because the rails 80A and 82A are situated substantially below the platform surface 38, the resulting combination of the head 30 and the differential 144 takes on a relatively low profile.

Figure 14:
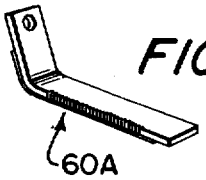
FIG. 14 is a perspective view of a wide angle adapter bar utilized on the head when the configuration of FIG. 13 is to be obtained.
Figure 13:
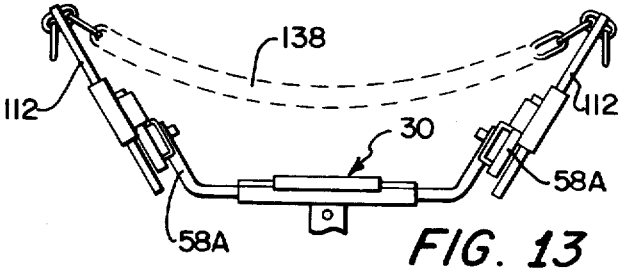
FIG. 13 is an end elevational view of the head with certain of the adapter components arranged to provide a wide angle receiving space for an object such as a fuel tank or the like (not shown)

FIGS. 13 and 14 show the head 30 adapted particularly to receive wide-bodied objects such as, for example, fuel tanks or the like. In this regard, the adapter bars 56, 60, 62 and 64 are replaced by the so-called "wide-angle" adapter bars of the type illustrated in FIG. 5 and designated by the numeral 60A. The bar 60A is also illustrated in FIG. 14, and it may be seen viewing FIG. 13 that when the wide-angled bars are used on opposite sides of the head 30, the result is to form a cradling area that flares outwardly and upwardly to present a wide reception for the object to be supported. The chains 138 are slung between the posts 112 in the usual way, and all adjustments as previously described with respect to FIGS. 1–3 can also be made with respect to the arrangement of FIGS. 13 and 14.

FIGS. 15 and 16 show an arrangement in which the head 30 is adapted for supporting a power divider 176 having a configuration differing from the power divider 140 of FIG. 8 and also having a circle of bolts 178 which can be used to advantage insofar as attaching the same to the jack 10 is concerned. In this arrangement the short rails 80A and 82A are preferably utilized and the bars 56, 60, 62 and 64 are inverted as in the arrangements of FIGS. 8 and 11. The fastener units 146 and 148 are utilized in the same manner as with the differential 144 of FIG. 11 although, preferably, the arms 164 are angled downwardly and inwardly rather than upwardly and inwardly such that the bolts 172 associated with the fastener units 146,148 take the place of a pair of the lower bolts 178 in the bolt circle on opposite sides of the lowermost bolt 178 in the circle.

The upper rear portion of the power divider 146 projects onto and overlies the front portion of the platform surface 38 and rides upon the front edge **38*a* thereof. The "tiedown" arrangement of FIG. 8 is utilized with the chain 138 looped over the rearwardly projecting shaft 180 of the power divider 176. Once again, a relatively low profile is obtained for the combination of the head 30 and the transported object in the form of the powder divider 176**, and the latter can be lowered substantially down to the floor surface.

FIG. 17 shows the head 30 especially suited to receive and support a transmission 182. Preferably, the arrangement is substantially as shown with respect to FIGS. 1–3, except that the rear units 94 are positioned between, rather than outboard of, the bars 56,62 and 60,64. The chains 138 are slung beneath the transmission 182 in the usual manner, and it will be noted that the posts 112 may be positioned at relatively different heights in order to best adapt the arrangement to receive the transmission 182 with its special contours and protrusions.

FIGS. 18 and 19 relate to adapting the head 30 for drive shaft and axle assemblies. The arrangement is substantially the same as that of FIGS. 1–3, except that the "narrow-angle" bars 56B, 60B, 62B and 64B are utilized so as to present an upwardly and inwardly tapering cradling area as well shown in FIG. 18.

From the foregoing detailed description, it should be apparent that the present invention provides a substantial advance in the art in a number of significant respects. For example, as is clearly apparent, the adapter components of the present invention render the jack 10 highly flexible and permit the mechanic to cope with virtually any irregularly-shaped gear train component with which he might be confronted. Moreover, whereas prior to the present invention it frequently required two or more men to maneuver and manage a relatively heavy gear train component even when a lifting jack was utilized, by virtue of the present invention one man can carry out the complete process of removing, servicing and replacing the component in need of repair. And the various adjustments necessary to adapt the jack 10 to the particular component being serviced can be carried out quite rapidly and with a minimum of effort even while the jack is positioned beneath the vehicle being serviced. In this regard, virtually all of the adjustments can be made manually and through an infinite range between fixed limits, all of which promotes safety, reduces man hours consumed in service time and otherwise promotes servicing efficiencies.

I claim:

1. In a jack having a load-carrying head that is raised and lowered during operation of the jack, means adapting said head for the reception and support of irregularly-shaped, relatively heavy objects, said adapting means comprising:

a pair of elongated rails;

structure attaching said rails to said head in laterally spaced relationship along opposite sides of the head; and a pair of carriage assemblies adapted for load-supporting engagement with an object to be handled by the jack and mounted on opposite ones of said rails for selective, independent adjustment along the latter and relative to said head into any one of a number of selectable positions according to the characteristics of the particular object to be handled by the jack, said attaching structure including means operable to permit selective, independent lateral shifting of said rails whereby the position of said carriages relative to said head may be selectively adjusted in at least three independent directions.

2. In a jack as claimed in claim 1, wherein each of said carriage assemblies includes a component thereof that is selectively shiftable between a number of selectable, generally vertically disposed positions relative to said head in order to accommodate the characteristics of the particular object being handled by the jack, said components being shiftable independently of one another.

3. In a jack as claimed in claim 1, wherein each bracket is provided with a generally upwardly projecting stud, said mounting means having a socket associated therewith and adapted to removably receive said stud whereby to render the mounting means and said component selectively removable from their bracket.

4. In a jack as claimed in claim 1, wherein said coupling means comprises a flexible element adapted to be slung between the component of a unit on one of said rails and the component of an opposite unit on the other of said rails and under the object to be handled by the jack.

5. In a jack as claimed in claim 1, wherein one unit on each of said rails comprises a bracket slidably receiving the corresponding rail, an elongated, generally upright component having means adjacent the upper end thereof for coupling the same with the object to be handled by the jack, and means mounting said component on the bracket for selective vertical adjustment of the component relative to the bracket, the other unit of each carriage assembly including a mount slidably receiving the corresponding rail, and a fastener assembly attached to said mount for movement therewith and including a threaded element for threadably fastening the mount to the object to be handled by the jack.

6. In a jack as claimed in claim 1, wherein each of said carriage assemblies includes a unit on the corresponding rail shiftable along the same independently of the other unit, each of said units including a mount slidably receiving the corresponding rail, and a fastener assembly attached to said mount for movement therewith and including a threaded element for threadably fastening the mount to the object to be handled by the jack.

7. In a jack having a load-carrying head that is raised and lowered during operation of the jack, means adapting said head for the reception and support of irregularly-shaped, relatively heavy objects, said adapting means comprising:

a pair of elongated rails;

structure attaching said rails to said head in laterally spaced relationship along opposite sides of the head; and a pair of carriage assemblies adapted for load-supporting engagement with an object to be handled by the jack and mounted on opposite ones of said rails for selective, independent adjustment along the latter and relative to said head into any one of a number of selectable positions according to the characteristics of the particular object to be handled by the jack, each of said carriage assemblies including a pair of separate units on each of said rails, said units being shiftably independently of one another along their corresponding rails, each of said units comprising a bracket slidably receiving the corresponding rail, on elongated, generally upright component having means adjacent the upper end thereof for coupling the same with the object to be handled by the jack, and means mounting said component on the bracket for selective positioning of the component in any one of a number of selectable, generally vertically disposed positions relative to said bracket, said mounting means including a series of ratchet teeth along one normally generally vertically disposed stretch of each component and movable with the same during selective adjustment thereof, said mounting means further including a spring loaded pawl adapted to remain with said bracket during said adjustment of the component and biased into releasable engagement with said teeth in a manner to permit generally upward adjustment of the component without release of the pawl but permit generally downward adjustment of the component only upon release of the pawl.

8. In a jack as claimed in claim 7, said head including an upper load-carrying surface adapted to normally supportingly engage the object being handled by the jack, said structure including a pair of generally L-shaped bars for each rail, one normally generally horizontally extending leg of each bar being attached to and projecting outwardly from the head and the other normally generally vertically extending leg of each bar being attached to the corresponding rail at a location to dispose the latter outboard of each vertically spaced from said surface, said bars being provided with means for releasable attaching the same to the head in either of a selected one of a pair of orientations; and said bars being positioned with said other legs thereof projecting upwardly above said surface in a first of said orientations and being positioned with said other legs thereof projecting downwardly below said surface in the second of said orientations whereby to correspondingly locate said rails with respect to said surface.

9. In a jack as claimed in claim 8, wherein said bars are provided with means attaching the same to the head for independent adjustment of the bars on opposite sides of the head toward and away from one another whereby to correspondingly adjust the rails toward and away from one another.

10. In a jack as claimed in claim 9, wherein each of said carriage assemblies includes a pair of separate units on each of said rails, said units being shiftable independently of one another along their corresponding rails.

11. In a jack as claimed in claim 10, wherein each of said units comprises a bracket slidably receiving the corresponding rail, an elongated, generally upright component having means adjacent the upper end thereof for coupling the same with the object to be handled by the jack, and means mounting said component on the bracket for selective positioning of the component in any one of a number of selectable, generally vertically disposed positions relative to said bracket.

12. In a jack as claimed in claim 8, wherein said jack includes a set of ground wheels rendering the jack movable along a floor or the like, said head being lowerable to a lowermost position spaced above the normal point of contact of said wheels with the floor, said carriage assemblies being shiftable to positions on said rails when the bars are in said second orientation adapting the rails to carry an object substantially below said surface adjacent the floor and beyond a terminal edge of said surface.

13. In a jack as claimed in claim 8, wherein said other leg of each bar is substantially perpendicular to said one leg of the bar.

14. In a jack as claimed in claim 8, wherein said other leg of each bar projects from said one leg at an obtuse angle.

15. In a jack as claimed in claim 8, wherein said other leg of each bar projects from said one leg at an acute angle.

* * * * *